US005708464A

United States Patent [19]

Desie

[11] Patent Number: 5,708,464

[45] Date of Patent: Jan. 13, 1998

[54] DEVICE FOR DIRECT ELECTROSTATIC PRINTING (DEP) WITH "PREVIOUS CORRECTION"

[75] Inventor: Guido Desie, Herent, Belgium

[73] Assignee: Agfa-Gevaert N.V., Mortsel, Belgium

[21] Appl. No.: 743,545

[22] Filed: Nov. 4, 1996

[30] Foreign Application Priority Data

Nov. 9, 1995 [EP] European Pat. Off. ..... 95203051

[51] Int. Cl.[6] ..... B41J 2/06

[52] U.S. Cl. ..... 347/55; 347/195

[58] Field of Search ..... 399/135; 347/55, 347/195, 196

[56] References Cited

U.S. PATENT DOCUMENTS

| | | | |
|---|---|---|---|
| 4,860,036 | 8/1989 | Schmidlin . | |
| 5,040,004 | 8/1991 | Schmidlin et al. . | |
| 5,136,311 | 8/1992 | Hays . | |
| 5,214,451 | 5/1993 | Schmidlin et al. . | |
| 5,377,159 | 12/1994 | Endo | 347/195 |
| 5,400,062 | 3/1995 | Salmon | 347/55 |
| 5,404,155 | 4/1995 | Kitamura | 347/151 |
| 5,483,273 | 1/1996 | Fujimoto et al. | 347/195 |
| 5,546,113 | 8/1996 | Izumi | 347/195 |
| 5,614,932 | 3/1997 | Kagayama | 347/55 |
| 5,625,399 | 4/1997 | Wiklof et al. | 347/195 |
| 5,631,679 | 5/1997 | Kagayama | 347/55 |
| 5,633,110 | 5/1997 | Desie et al. | 347/55 X |
| 5,644,351 | 7/1997 | Matsumoto et al. | 347/194 |

OTHER PUBLICATIONS

Patent Abstracts Of Japan; vol. 017, No. 286 (M--1422), Jun. 2, 1993 and JP--A--05016422 (Tokyo Electric Co., Ltd.), Jan. 26, 1993.

*Primary Examiner*---Matthew S. Smith

*Attorney, Agent, or Firm*---Brumbaugh, Graves, Donohue & Raymond

[57] ABSTRACT

A DEP device adapted for grey-scale printing comprising a back electrode (105), a printhead structure (106), an array of printing apertures (107) in the printhead structure (106) through which a particle flow can be electrically modulated by a control electrode (106a), a toner delivery means (101), at least one control means (111) for applying an electric field to the control electrodes, wherein:

(i) the control means controls each single control electrode to enable the printing through each single printing aperture (107) of pixel dots (PD), each of the pixel dots intended to have a density D, and (ii) the control means controls the printing of the pixel dots through the each single printing aperture as a function of both the intended density ($D_{intend}$) and the density ($D_{prev}$) previously produced through the single printing aperture, i.e. the control means use "previous correction".

6 Claims, 1 Drawing Sheet

DEVICE FOR DIRECT ELECTROSTATIC PRINTING (DEP) WITH "PREVIOUS CORRECTION"

FIELD OF THE INVENTION

This invention relates to an apparatus used in the process of electrostatic printing and more particularly in Direct Electrostatic Printing (DEP). In DEP, electrostatic printing is performed directly from a toner delivery means on a receiving member substrate by means of an electronically addressable printhead structure.

BACKGROUND OF THE INVENTION

In DEP (Direct Electrostatic Printing) the toner or developing material is deposited directly in an imagewise way on a receiving substrate, the latter not bearing any imagewise latent electrostatic image. The substrate can be an intermediate endless flexible belt (e.g. aluminium, polyimide etc.). In that case the imagewise deposited toner must be transferred onto another final substrate. Preferentially the toner is deposited directly on the final receiving substrate, thus offering a possibility to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed in e.g. U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode.

A DEP device is well suited to print half-tone images. The densities variations present in a half-tone image can be obtained by modulation of the voltage applied to the individual control electrodes. In most DEP systems large apertures are used for obtaining a high degree of density resolution (i.e. for producing an image comprising a high amount of differentiated density levels).

For text quality, however, a high spatial resolution is required. This means that small apertures must have to be made through said plastic material, said control electrodes and said shield electrode.

If small apertures are used in the printhead structure in order to obtain a high spatial resolution, then the overall printing density is rather low. This means that either the printing speed too is rather low, or that multiple overlapping rows of addressable apertures have to be implemented, yielding a complex printhead structure and printing device.

By using apertures with a large aperture diameter, it is also advisable to provide multiple rows of apertures in order to obtain an homogeneous grey density for the whole image.

Printhead structures with enhanced density and/or spatial control have been described in the literature. In U.S. Pat. No. 4,860,036 e.g. a printhead structure has been described consisting of at least 3 (preferentially 4 or more) rows of apertures which makes it possible to print images with a smooth page-wide density scale without white banding. The main drawback of this kind of printhead structure deals with the toner particle application module, which has to be able to provide charged toner particles in the vicinity of all printing apertures with a nearly equal flux. In U.S. Pat. No. 5,040,004 it is disclosed to solve this problem by the introduction of a moving belt which slides over an accurately positioned shoe that is placed at close distance from the printhead structure. However, it is evident that a toner application module operated by a friction method cannot provide stable results over long periods of time, due to wear of the belt by the friction of the belt over said shoe.

In U.S. Pat. No. 5,214,451 it is disclosed that the problem of providing charged toner particles in the vicinity of all printing apertures with a nearly equal flux, could be solved by the application of different sets of shield electrodes upon the printhead structure, each shield electrode corresponding to a different row of apertures. During printing the voltage applied to the different shield electrodes corresponding to the different rows of apertures is changed, so that these apertures that are located at a larger distance from the toner application module are tuned for a larger electrostatic propulsion field from said toner application module towards said back electrode structure, resulting in enhanced density profiles.

In U.S. Pat. No. 5,136,311 a charged toner conveyer is described which is stretched over 4 roller bars so that a flat surface is positioned adjacent to said receiving member. In this case no printhead structure is used, but opposite to said receiving member and on the side facing away from said charged toner conveyer an electrode structure is constructed that makes it possible to image-wise jump said charged toner on said charged toner conveyer to said receiving member. In this document no examples are given, but pushing said toner to said receiving member from behind said charged toner conveyer must lead to less accurate control over said toner flow in comparison with apparatus where said toner flow is controlled by a printhead structure which is positioned between said charged toner conveyer and said receiving member.

In U.S. Pat. No. 5,404,155 a direct electrostatic printing device is described wherein the overall homogeneity of the image is enhanced by taking into account that the potentials applied to neighbouring apertures have an influence upon the potential that has to be applied to the actual aperture in order to obtain a pixel density of constant and reproducible value.

The apparatus described above do solve, to higher or lower extent, the problem of providing charged toner particles in the vicinity of all printing apertures with a nearly equal flux, but do not give any benefit in order to obtain a constant toner flux for all printing apertures as a function of printing time and previous image data. As a consequence it remains very difficult to obtain grey-scale images with constant grey density over printing time irrespective of the image density of previous image parts.

There is thus still a need for a DEP system comprising a printhead structure comprising multiple rows of apertures, a toner application module with appropriate geometry and dimension, and an electric field control means for controlling a flow of toner particles from said toner particle supplying means to said image recording medium, whereby previous image densities do not influence the actual image density to be printed at any given printing time.

OBJECTS AND SUMMARY OF THE INVENTION

It is an object of the invention to provide an improved Direct Electrostatic Printing (DEP) device, printing with high density resolution and high spatial resolution.

It is a further object of the invention to provide a DEP device combining high spatial and density resolution with good long term accuracy and reliability.

It is still a further object of the invention to provide an electric field control means for a DEP device, wherein the density of certain image parts is controlled very accurately by taking into account the density of previous image parts.

It is an other object of the invention to provide a DEP device wherein an equal density can be printed at a certain place and at a certain printing time are, irrespective of the density printed in the neighbourhood and at an earlier time.

Further objects and advantages of the invention will become clear from the detailed description hereinafter.

The above objects are realized by providing a DEP device that comprises:

a back electrode (105), a printhead structure (106), an array of printing apertures (107) in said printhead structure (106) through which a particle flow can be electrically modulated by a control electrode (106*a*), a toner delivery means (101), at least one control means for applying an electric field to said control electrodes, wherein:

(i) said control means controls each single control electrode to enable the printing through each single printing aperture (107) of pixel dots (PD), each of said pixel dots intended to have a density D, and (ii) said control means controls said printing of said pixel dots through "previous correction".

DETAILED DESCRIPTION OF THE INVENTION

Definitions

Figure 1:
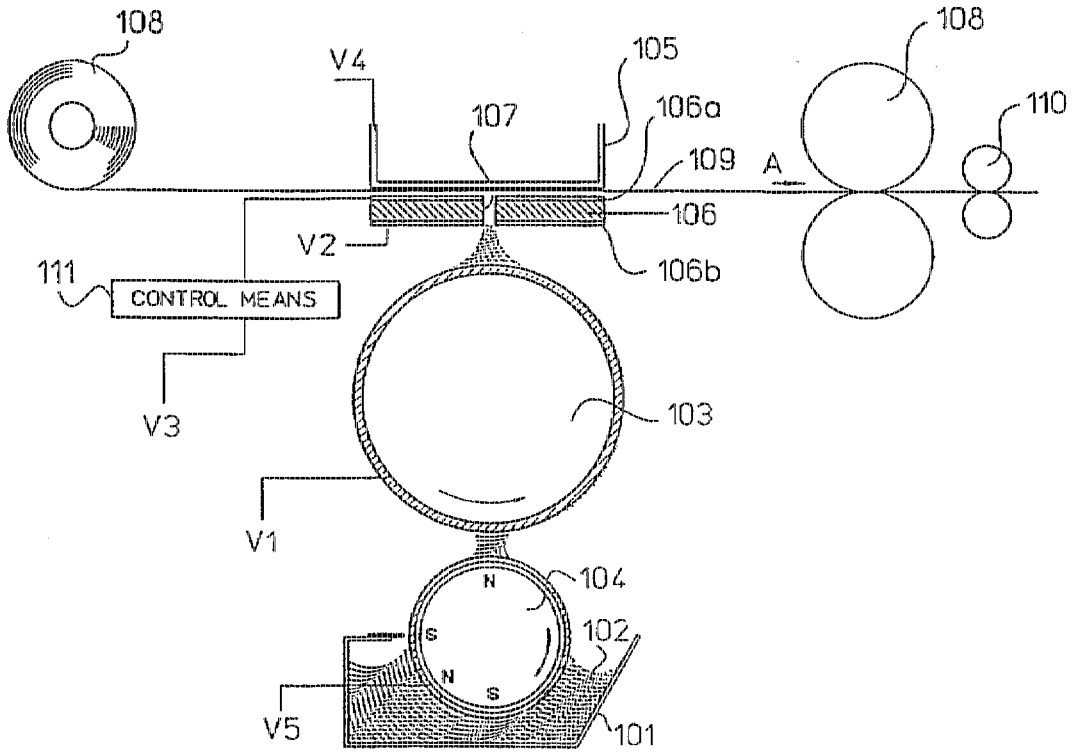
FIG. 1 is a schematic illustration of a possible embodiment of a PEP device according to the present invention.

Line time (LT): the time interval for printing one pixel dot. When an aperture is kept open during the total line time, maximum density is achieved in that one pixel dot.

Write time (WRT): a fraction of LT. By changing WRT grey scale printing is effected. In an embodiment of our invention, e.g., LT is divided in 128 parts, and WRT varies between 0/128 LT to 128/128 LT.

Wait time (WAT): LT−WRT=WAT.

Description of a DEP device

A non limitative example of a device for implementing a DEP method using toner particles according to the present invention comprises (FIG. 1):

(i) a toner delivery means (101), comprising a container for 8 developer (102), a charged toner conveyer (103) and a magnetic brush (104), this magnetic brush forming a layer of charged toner particles upon said charged toner conveyer (ii) a back electrode (105)

(iii) a printhead structure (106), made from a plastic insulating film, coated on both sides with a metallic film. The printhead structure (106) comprises one continuous electrode surface, hereinafter called "shield electrode" (106*b*) facing in the shown embodiment the toner delivering means and a complex addressable electrode structure, hereinafter called "control electrode" (106*a*) around printing apertures (107), facing, in the shown embodiment, the toner-receiving member in said DEP device. Said printing apertures are arranged in an array structure for which the total number of rows can be chosen according to the field of application. The location and/or form of the shield electrode (106*b*) and the control electrode (106*a*) can, in other embodiments of a device for a DEP method using toner particles according to the present invention, be different from the location shown in FIG. 1.

(iv) conveyer means (108) to convey an image receptive member (109) for said toner between said printhead structure and said back electrode in the direction indicated by arrow A.

(v) means for fixing (110) said toner onto said image receptive member.

(vi) electric field control means (111) that controls the electric field applied to said individual control electrodes (106*a*).

Between said printhead structure (106) and the charged toner conveyer (103) as well as between the control electrode around the apertures (107) and the back electrode (105) behind the toner receiving member (109) as well as on the single electrode surface or between the plural electrode surfaces of said printhead structure (106) different electrical fields are applied. In the specific embodiment of a device, useful for a DEP method, shown in FIG. 1. voltage V1 is applied to the sleeve of the charged toner conveyer 103, voltage V2 to the shield electrode 106*b*, voltages $V3_0$ up to $V3_n$ for the control electrode (106*a*). Voltage V4 is applied to the back electrode behind the toner receiving member. In other embodiments of the present invention multiple voltages $V2_0$ to $V2_n$ and/or $V4_0$ to $V4_n$ can be used. Voltage V5 is applied to the surface of the sleeve of the magnetic brush.

It was found that the density printed through a printing aperture, for a given electric field applied to the control electrode, during $LT_n$ (the $n^{th}$ linetime used to print the $n^{th}$ line) depended on the density that had been printed during $LT_{n-1}$ (the $(n-1)^{th}$ line time). The image density for a given pixel at a certain printing time is thus not only determined by its grey-scale value, BUT also by the image density of previous pixels printed through the see printing aperture. It was found that even printing could be achieved when said control means, controlling the electrical field applied to the control electrode, control the printing of the pixel dots through said each single printing aperture as a function of both said intended density ($D_{intend}$) at $LT_n$ and the density ($D_{prev}$) previously produced through said single printing aperture at $LT_{n-1}$. This "previous correction" for the previous printed density is incorporated in the control means.

All DEP devices are able to perform grey scale printing. For grey scale printing the electric field applied to the control electrode can be controlled either by voltage modulation or by time modulation or by an combination of both.

The electric field applied to the control electrode is, in a device according to the present invention, controlled by the control means, in the case when grey scale printing is performed only by voltage modulation, in a way as described immediately below.

When only voltage modulation is used for grey scale printing, in a DEP device according to the present invention, the write time (WRT) of each pixel is equal to the line time (LT), but the amount of toner particles passing through the printing aperture is controlled by applying a weaker or stronger blocking voltage (V3). For instance in a DEP device, comprising a backelectrode with V4=+600 V, the printing by negatively charged toner particles through a printing aperture can totally be blocked when $V3_n$=−300 V and maximum density is achieved when $V3_0$=0 V to the control electrode. For printing densities in between maximum density and minimum density, V3 is varied between the values $V3_0$ and $V3_n$. The "previous correction" to be applied to a V3 value, between the two extreme V3 values, at $LT_n$, to print the intended density ($D_{intend}$), depends on the voltage V3 used while printing at $LT_{n-1}$, and the real value of V3 at $LT_n$ ($V3_{real}$) can be calculated from the intended value of V3 at $LT_n$ ($V3_{intend}$) according to following formula I:

$$V3_{real}=V3_{intend}+V3_{prev}\times K_v I$$

wherein $V3_{prev}$ is the value of V3 at $LT_{n-1}$, used to print $D_{prev}$ and $K_v$ is a correction factor. $K_v<1$, preferably $K_v<0.5$, most preferably $K_v\leqq 0.20$.

For example when the blocking voltage ($V3_n$) is −300 V and it is indented to print half of maximum density ($D_{half}$), $V3_{intend}$ is e.g., −150 V. When however, before printing $D_{half}$, a minimum density has been printed, i.e. when $V3_{prev}$ was −300 V, $V3_{real}$ for $D_{half}$ becomes according to formula I:

$$V3_{real}=-150\ V+(-300\ V\times 0.15)=-150\ V+(-45\ V)=-195\ V$$

with $K_v$=0.15.

In the case when grey scale printing is performed only by time modulation, the electric field applied to the control electrode is, in a device according to the present invention, controlled by the control means in a way as described immediately below.

When only time modulation is used for grey scale printing, in a DEP device according to the present invention, the line time (LT) is divided into several smaller time units. The grey scale printing proceeds by having a voltage $V3_0$ (voltage allowing maximum density to be printed) at the control electrode during a certain number of said smaller time units (i.e. during the write time (WRT)) and having a voltage $V3_n$ (blocking voltage giving minimum density) during LT−WRT=WAT (wait time). The above implies that maximum density is printed when WRT=LT and minimum density when WRT=0. The printing of intermediate densities proceed at values of WRT between these two extremes.

The "previous correction" to be applied to a WRT value between the two extreme values at $LT_n$, to print the intended density, depends on the write time ($WRT_{prev}$) used while printing at $LT_{n-1}$, and the real value of WRT at $LT_n$ ($WRT_{real}$) can calculated from the intended value of WRT at $LT_n$ ($WRT_{intend}$) according to following formula II:

$$WRT_{real}=WRT_{intend}-((LT-WRT_{prev})\times K_t) \qquad \text{II}$$

wherein $WRT_{prev}$ is the value of WRT at $LT_{n-1}$, LT is the line time and $K_t$ is a correction factor. $K_t<1$, preferably $K_t<0.5$, most preferably $K_t\leqq 0.20$.

When, e.g., LT=16 ms and is divided in 128 smaller time units (called sublines (SL)), then the WRT giving maximum density is (128/128) LT or 16 ms and the WRT giving minimum density is (0/128)LT or 0 ms. Printing of half maximum density ($D_{half}$) requires e.g. a $WRT_{intend}$ of (64/128)LT or of 8 ms. When however, before printing $D_{half}$, a minimum density has been printed, i.e. when $WRT_{prev}$ was (0/128)LT or 0 ms, $WRT_{real}$ for $D_{half}$ becomes, according to formula II:

$$WRT_{real}=8\ ms-((16\ ms-0\ ms)\times 0.15)=5.6\ ms,\ \text{with}\ K_t=0.15.$$

It is also possible, in a DEP device according to the present invention, to use control means that can control the electric fields on the control electrode both by time- and voltage modulation. When using such a control means, it is preferred to perform the correction for the previously printed density by correcting the time-modulating part of the correction means.

In its most simple and preferred form, a device according to the present invention incorporates control means for the electrical field applied to a given control electrode (voltage of time-modulated) that makes it possible to correct the field that is applied for the density of only the previous image dot written through the same printing aperture. In a more complicated form, the electric field used to print an intended density through a given printing aperture is, in a DEP device according to this invention, not only corrected for the electrical field used for density printed immediately before, but also for the electrical field used to print the density of more than one previous image dot. This correction, taking in account the electrical field used to print the density of more earlier image dots, can be driven as far as necessary: when only a rough correction is necessary, the correction is restricted to take in account the electrical fields used to print at most two previous dots. This way of proceeding is illustrated hereinunder below. When a very accurate correction is desirable the number of earlier dots taken in account can be extended at wish.

The algorithm for calculating this correction (explained for m previous dots) can be sequential. E.g. in a device according to the present invention using only time modulation the "previous correction" can proceed via formula III:

$$WRT_{real} = WRT_{intend} - ((LT - WRT_{prev1}) \times K_{t1}) - ((LT - WRT_{prev2}) \times K_{t2}) - \ldots - ((LT - WRT_{prev(m-1)}) \times K_{t(m-1)}) - ((LT - WRT_{prevm}) \times K_{tm} \quad \text{(III)}$$

In this formula, $WRT_{prev1}$ is the value of the write time WRT at $LT_{n-1}$, $WRT_{prev2}$ is the value of WRT at $LT_{n-2}$, $WRT_{prev(m-1)}$ is the value of WRT at $LT_{n-(m-1)}$, $WRT_{prevm}$ is the value of WRT at $LT_{n-m}$, LT is the line time, $K_{t1}$ is a correction factor at $LT_{n-1}$, $K_{t2}$ is a correction factor at $LT_{n-2}$, $K_{t(m-1)}$ is a correction factor at $LT_{n-(m-1)}$ and $K_{tm}$ is a correction factor at $LT_m$, m is the number of previous pixels dots that are taken into account for performing the "previous correction". In the formula III, $K_{t1}<1$, preferably $K_{t1}<0.5$, most preferably $K_{t1} \leqq 0.20$, and $0.5 \leqq K_{t2}/K_{t1} \leqq 0.1$, . . . $0.5 \leqq K_{tm}/K_{t(m-1)} \leqq 0.1$. I.e., most preferably, each next correction factor has a value between 50 and 10% of the previous one.

The correction of the electric field applied to a control electrode, in a device according to the present invention, taking in account the electric fields applied to more than one previous pixel dot, can also proceed in a recursive way. This means that as $WRT_{prev}$ for calculating the $WRT_{real}$ for each following dot, the $WRT_{real}$ (i.e. the WRT that is corrected for the previous pixel) of the previous dot is taken in to account. E.g. in a device according to the present invention using only time modulation the correction can again proceed a repetitive use of formula II (above), where the $WRT_{prev}$ is at each repetition the $WRT_{real}$ of the forgoing calculation.

For example: with LT=16 ms and $WRT_{intend1}$=64/128 LT or 8 ms for the printing of the first pixel after printing at WRT=0 ($WRT_{prev}$=0), the $WRT_{real1}$ is 5.6 ms for $K_t$=0.15. The second pixel, having again a $WRT_{intend2}$=64/128 LT, is printed with a $WRT_{real2}$, that is corrected for $WRT_{prev}$=$WRT_{real1}$ again with $K_t$=0.15. The third pixel, having again a $WRT_{intend3}$=64/128 LT, is printed with a $WRT_{real3}$, that is corrected for $WRT_{prev}$=$WRT_{real2}$ again with $K_t$=0.15. This procedure is repeated for each following pixel.

The correction, explained above, can also be executed when the grey-scale is printed by voltage modulation. On the basis of formula I, the way of calculating the way to correct the voltage of the electric fields on the control electrodes taking in account more the electric fields of more than one previous pixel dot, can easily be construed.

Although a "previous correction" according to the present invention can, as explained above, be implemented when voltage modulation as well as when time modulation is used for grey scale printing, it is preferred to implement the "previous correction" according to this invention in DEP devices using time modulation for grey scale printing.

The "previous correction" can, in a device according to this invention, when necessary be combined with a neighbouring correction. I.e. the electrical field used on a printing aperture to produce an intended density is corrected for the electrical fields that are applied to the neighbouring printing apertures. Such correction means, taking in account only one neighbouring aperture on each side i.e. for adjacent neighbours, have been described in e.g. U.S. Pat. No. 5,404,155.

Depending on the actual configuration to be used and the quality of the images that is wanted, any combination of single or multiple previous compensation and/or single or multiple neighhour compensation can be used.

Although in FIG. 1 an embodiment of a device for a DEP method using two electrodes (106*a* and 106*b*) on printhead 106 is shown, it is possible to implement a DEP method, using toner particles according to the present invention using devices with different constructions of the printhead (106). It is, e.g. possible to implement a DEP method with a device having a printhead comprising only one electrode structure as well as with a device having a printhead comprising more than two electrode structures. The apertures in these printhead structures can have a constant diameter, or can have a broader entrance or exit diameter. The back electrode (105) of this DEP device can also be made to cooperate with the printhead structure, said back electrode being constructed from different styli or wires that are galvanically isolated and connected to a voltage source as disclosed in e.g. U.S. Pat. No. 4,568,955 and U.S. Pat. No. 4,733,256. The back electrode, cooperating with the printhead structure, can also comprise one or more flexible PCB's (Printed Circuit Board).

A DEP device according to the present invention can be operated successfully when a single magnetic brush is used in contact with the CTC to provide a layer of charged toner on said CTC.

In a DEP device according to a further embodiment of the present invention, said toner delivery means 101 creates a layer of toner particles upon said charged toner conveyer from two different magnetic brushes with multi-component developer (e.g. a two-component developer, comprising carrier and toner particles wherein the toner particles are triboelectrically charged by the contact with carrier particles or 1.5 component developers, wherein the toner particles get tribo-electrically charged not only by contact with carrier particles, but also by contact between the toner particles themselves).

In a DEP device according to the present invention an additional AC-source can be connected to the sleeve of a single magnetic brush or to any of the sleeves of a device using multiple magnetic brushes.

In a DEP device according to an other embodiment of the present invention said charged toner particles are extracted directly from a magnetic brush containing mono-component or multi-component developer.

The magnetic brush 104 (or plural magnetic brushes) preferentially used in a DEP device according to the present invention is of the type with stationary core and rotating sleeve.

In a DEP device, according to of the present invention and using a magnetic brush of the type with stationary core and rotating sleeve, any type of known carrier particles and toner particles can successfully be used. It is however preferred to use "soft" magnetic carrier particles. "Soft" magnetic carrier particles useful in a DEP device according to a preferred embodiment of the present invention are soft ferrite carrier particles. Such soft ferrite particles exhibit only a small amount of remanent behaviour, characterised in coercivity values ranging from about 50 up to 250 Oe. Further very useful soft magnetic carrier particles, for use in a DEP device according to a preferred embodiment of the present invention, are composite carrier particles, comprising a resin binder and a mixture of two magnetites having a different particle size as described in EP-B 289 663. The particle size of both magnetites will vary between 0.05 and 3 μm. The carrier particles have preferably an average volume diameter ($d_{v50}$) between 10 and 300 μm, preferably between 20 and 100 μm. More detailed descriptions of carrier particles, as mentioned above, can be found in EP-A 675 417, that equals the co-pending U.S. Ser. No. 08/411,540, filed on Mar. 28, 1995, that is incorporated herein by reference.

It is preferred to use in a DEP device according to the present invention, toner particles with an absolute average charge (|q|) corresponding to 1 fC≦|q|≦20 fC, preferably to 1 fC≦|q|≦10 fC. The absolute average charge of the toner particles is measured by an apparatus sold by Dr. R. Epping PES-Laboratorium D-8056 Neufahrn, Germany under the name "q-meter". The q-meter is used to measure the distribution of the toner particle charge (q in fC) with respect to a measured toner diameter (d in 10 μm). From the absolute average charge per 10 μm (|q|/10 μm) the absolute average charge |q| is calculated. Moreover it is preferred that the charge distribution, measured with the apparatus cited above, is narrow, i.e. shows a distribution wherein the coefficient of variability (v), i.e. the ratio of the standard deviation to the average value, is equal to or lower than 0.33. Preferably the toner particles used in a device according to the present invention have an average volume diameter ($d_{v,50}$) between 1 and 20 μm, more preferably between 3 and 15 μm. More detailed descriptions of toner particles, as mentioned above, can be found in EP-A 675 417, that equals the co-pending U.S. Ser. No. 08/411,540, filed on Mar. 28, 1995, that is incorporated herein by reference.

A DEP device making use of the above mentioned marking toner particles can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the voltage V3 applied on the control electrode 106*a* or by a time modulation of V3. By changing the duty cycle of the time modulation at a specific frequency, it is possible to print accurately fine differences in grey levels. It is also possible to control the grey level printing by a combination of an amplitude modulation and a time modulation of the voltage V3, applied on the control electrode.

The combination of a high spatial resolution and of the multiple grey level capabilities typical for DEP, opens the way for multilevel halftoning techniques, such as e.g. described in the EP-A 634 862, that equals U.S. co-pending U.S. Ser. No. 08/271,343 filed on Jul. 6, 1994. This enables the DEP device, according to the present invention, to render high quality images.

EXAMPLES

Throughout the printing examples, the same developer, comprising toner and carrier particles was used.

The carrier particles

A macroscopic "soft" ferrite carrier consisting of a MgZn-ferrite with average particle size 50 μm, a magnetisation at saturation of 29 emu/g was provided with a 1 μm thick acrylic coating. The material showed virtually no remanence.

The toner particles

The toner used for the experiment had the following composition: 97 parts of a co-polyester resin of fumaric acid and bispropoxylated bisphenol A, having an acid value of 18 and volume resistivity of $5.1\times10^{16}$ ohm.cm was melt-blended for 30 minutes at 110° C. in a laboratory header with 3 parts of Cu-phthalocyanine pigment (Colour Index PB 15:3). A resistivity decreasing substance—having the following formula: $(CH_3)_3N^+C_{16}H_{33}\,Br^-$ was added in a quantity of 0.5% with respect to the binder, as described in WO 94/027192. It was found that—by mixing with 5% of said ammonium salt—the volume resistivity of the applied binder resin was lowered to $5\times10^{14}$ Ω.cm. This proves a high resistivity decreasing capacity (reduction factor: 100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The average particle size was measured by Coulter Counter model Multisizer (tradename), was found to be 6.3 μm by number and 8.2 μm by volume. In order to improve the flowability of the toner mass, the toner particles were mixed with 0.5% of hydrophobic colloidal silica particles (BET-value 130 $m^2/g$).

The developer

An electrostatographic developer was prepared by mixing said mixture of toner particles and colloidal silica in a 4% ratio (w/w) with carrier particles. The triboelectric charging of the toner-carrier mixture was performed by mixing said mixture in a standard tumbling set-up for 10 min. The developer mixture was run in the magnetic brush for 5 minutes, after which the toner was sampled and the triboelectric properties were measured, according to a method as described in the above mentioned EP-A 675 417. The average charge, q, of the toner particles was −7.1 fC.

Measurement of printing quality

A printout made with a DEP device and developer described above, was judged for visual image quality in the following way: a graphic grey-scale image was printed and judged for overall image quality, especially the evenness of the image density of equal density patches with regard to differences in density between the edges and the middle of the even density patch. The results are given in table 1. In this table the data are summarized according to the following ranking:

1: unacceptable: great differences.

2: poor: differences between edges and middle still visible.

3: acceptable: no differences between edges and the middle are visible with the naked eye, only when magnifying 8 times some differences detectable.

4: good: density differences barely visible, even with 8 times magnification.

5: excellent: no density differences detectable with 8 times magnification.

Example 1 (E1)

The printhead structure (106)

A printhead structure 106 was made from a polyimide film of 50 μm thickness, double sided coated with a 7 μm thick copper film. On the back side of the printhead structure, facing the receiving member substrate, a ring shaped control electrode 106*a* was arranged around each aperture. Each of said control electrodes was individually addressable from a high voltage power supply. On the front side of the printhead structure, facing the toner delivery means, a common shield electrode (106*b*) was present. The printhead structure 106 had four rows of apertures. The apertures had an aperture diameter of 100 μm. The width of the copper ring electrodes was 50 μm. The rows of apertures were staggered to obtain an overall resolution of 200 dpi (dots per inch or dots per 25.4 mm).

For the fabrication process of the printhead structure, conventional methods of copper etching and plasma etching were used, as known to those skilled in the art.

The toner delivery means (101)

The toner delivery means 101 comprised a cylindrical charged toner conveyer (103) with a sleeve made of aluminium with a TEFLON (trade name) coating an a surface roughness of 2.5 μm (Ra-value measured according to ANSI/ASME B46.1-1985) and a diameter of 20 mm. The charged toner conveyer was rotated at a speed of 50 rpm. The charged toner conveyer 103 was connected to an AC power supply with a square wave oscillating field of 600 V at a frequency of 3.0 kHz with 20 V DC-offset.

Charged toner was propelled to this conveyer from a stationary core/rotating sleeve type magnetic brush (104) comprising two mixing rods and one metering roller. One rod was used to transport the developer through the unit, the other one to mix toner with developer.

The magnetic brush 104 was constituted of the so called magnetic roller, which in this case contained inside the roller assembly a stationary magnetic core, having three magnetic poles with an open position (no magnetic poles present) to enable used developer to fall off from the magnetic roller (open position was one quarter of the perimeter and located at the position opposite to said CTC (103).

The sleeve of said magnetic brush had a diameter of 20 mm and was made of stainless steel roughened with a fine grain to assist in transport (Ra=3 μm measured according to ANSI/ASME B46.1-1985) and showed an external magnetic field strength in the zone between said magnetic brush and said CTC of 0.045 T, measured at the outer surface of the sleeve of the magnetic brush.

A scraper blade was used to force developer to leave the magnetic roller. On the other side a doctoring blade was used to meter a small amount of developer onto the surface of said magnetic brush. The sleeve was rotating at 100 rpm, the internal elements rotating at such a speed as to conform to a good internal transport within the development unit. The magnetic brush 104 was connected to a DC power supply of −250V.

The reference surface of said CTC was placed at a distance of 1500 μm from the reference surface of said magnetic brush.

The distance B between the front side of the printhead structure 106 and the sleeve of the charged toner conveyer 103, was set at 350 μm. The distance between the back electrode 105 and the back side of the printhead structure 106 (i.e. control electrodes 106*a*) was set to 150 μm and the paper travelled at 1.25 cm/sec. The shield electrode 106*b* was grounded: V2=0 V. The back electrode 105 was connected to a high voltage power supply of +600 V. To the sleeve of the CTC an AC voltage of 600 V at 3.0 kHz was applied, with 20 V DC offset. To the individual control electrodes an (imagewise) voltage V3 of 0 V and −275 V (time modulated) was applied. A linear scale of 0 to 128 levels was used as time-modulated grey-scale, with LT=8 ms. The actual control electrode voltage for a given aperture and a given image pixel was corrected for the image density of the previous pixel according to formula II, with $K_f$=0.10, i.e. according to $$WRT_{real}=WRT_{intend}-((LT-WRT_{prev})\times K_f).$$

A graphics print, with first a number of pixels where printed with $WRT_{prev}$=0. When the printing was adjusted to give half density, i.e. $WRT_{intend}$=4 ms. After correction with $K_f$=0.10, the first pixel, for half density, was printed at $WRT_{real}$ of 3.2 ms.

Example 2 (E2)

In example 2 a graphic print was made with the same DEP printer as described in example 1, but for the image signal correcting means, the following scheme was used.

Again LT=8 ms. The "previous correction" was executed for the WRT of the 4 previous pixels, instead of for the last previous pixel only, according to formula III, wherein m=4 and $K_{r1}$=0.10, $K_{r2}$=0.05, $K_{r3}$=0.02 and $K_{r3}$=0.01.

Example 3 (E3)

In example 3 a print was made with the same DEP printer as described in example 1, but for the image signal correcting means, the following scheme was used.

Again LT=8, but $K_r$ was 0.15 instead of 0.10. The "previous correction" was executed for the WRT of the previous pixels, instead of for the last previous pixel only, according to the recursive use of formula II.

Comparative Example (CE)

In comparative example 1 the same DEP printer as described in example 1 was used but for the time-modulation used to print grey-scale images no correction for the previous pixel was used.

TABLE 1

| Example | Image Quality |
|---|---|
| E1 | 4 |
| E2 | 5 |
| E3 | 4 |
| CE1 | 1 |

From table 1 it is clear that the best results are obtained when the electric field control means takes into account the electrical field used to print previous imaging pixels (examples 1 to 3) if compared with no correction (comparative example).

The invention is described as a "previous correction" for diminishing the differences in density between the edges and the middle of even density patches. I.e. the present invention is described for suppressing edges. It is clear, that by switching the signs in the formulas I to III, the correction means of the present invention can be used for enhancing the difference in density between the edges and the middle of even density patches, i.e. the control means of the present invention can also be used for enhances the contours in an image, i.e. for "edge enhancement".

For those skilled in the art it will be clear that the same effects as those described in detail in the invention can be achieved by controlling the other electric fields present in a DEP device and that the control of V3 is a preferred embodiment of the invention, but that the invention is not restricted thereto.

I claim:

1. A DEP device adapted for grey-scale printing comprising:

a back electrode(105), a printhead structure(106), an array of printing apertures(107) in said printhead structure(106) through which a particle flow can be electrically modulated by a control electrode(106*a*), a toner delivery means(101), at least one control means(111) for applying an electric field to said control electrodes, wherein:

(i) said control means controls each single control electrode to enable the printing of pixel dots through each single printing aperture(107) each of said pixel dots intended to have a predetermined density, and, (ii) said control means controls said printing of said pixel dots using previous electrode parameter characteristics as correction data.

2. A DEP device according to claim 1, wherein said grey-printing is controlled by said control means by voltage modulation of electrical fields applied to said control electrodes according to the following formula:

$$V3real=V3intend+(V3prev\times Kv)$$

wherein,

V3real is the value of the real blocking voltage V3 at time LTn;

V3intend is the value of the blocking voltage V3 to be used at time LTn when previous correction data is not applied;

V3prev is the value of V3 at time LTn−1;

Kv is a correction constant that is smaller than 1;

LTn is a line time interval used to print an nth line; and,

LTn−1 is a line time interval used to print the n−1th line.

3. A DEP device according to claim 2, wherein $K_v \leqq 0.20$.

4. A DEP device according to claim 1, wherein said grey-scale printing is controlled by said control means by time modulation of electrical fields applied to said control electrodes according to the following formula:

$$WRTreal=WRTintend-((LT-WRTprev)\times Kt)$$

wherein,

WRTreal is the real value of the write time interval used at time LTn;

WRTintend is the value of the write time interval to be used at time LTn when previous correction data is not applied;

WRTprev is the value of the write time interval at LTn−1;

Kt is a correction constant that is smaller than 1;

LTn is the line time interval used to print an nth line;

LTn−1 is the line time interval used to print the n−1th line; and,

LT is the line time interval for printing a line.

5. A DEP device according to claim 1, wherein said correction data takes into account the electrical field used to print the density of more than one previous image dot.

6. A DEP device according to claim 1, wherein said correction data is combined with correction data of neighboring image dots.

* * * * *